United States Patent [19]

Pruyne et al.

[11] Patent Number: 4,779,663

[45] Date of Patent: Oct. 25, 1988

[54] PROCESS AND APPARATUS FOR PRODUCING DUCTILE IRON CASTINGS

[75] Inventors: Wilmot F. Pruyne, Naperville; John D. Page, Downers Grove, both of Ill.

[73] Assignee: Navistar International Transportation Corp., Chicago, Ill.

[21] Appl. No.: 142,294

[22] Filed: Jan. 4, 1988

Related U.S. Application Data

[63] Continuation of Ser. No. 898,769, Aug. 14, 1986, abandoned, which is a continuation of Ser. No. 630,546, Jul. 13, 1984, abandoned.

[51] Int. Cl.[4] ..... B22D 27/00

[52] U.S. Cl. ..... 164/58.1; 164/29; 164/55.1; 164/364

[58] Field of Search ..... 164/29, 55.1, 56.1, 164/59.1, 270.1, 57.1, 58.1, 349, 364

[56] References Cited

U.S. PATENT DOCUMENTS 4,436,142 3/1984 Mather ..... 164/55.1

FOREIGN PATENT DOCUMENTS 6306 1/1980 European Pat. Off. ..... 164/58.1

78611 5/1983 European Pat. Off. ..... 164/58.1

7712708 3/1979 Sweden ..... 164/57.1

OTHER PUBLICATIONS

"In Mold Nodulization with Delayed Pouring in Vertically Parted Molds", R. Sillen, *Modern Casting*, Jul., 1979, pp. 58–59.

*Primary Examiner*—Nicholas P. Godici
*Assistant Examiner*—Richard K. Seidel
*Attorney, Agent, or Firm*—F. David Aubuchon; Dennis K. Sullivan

[57] ABSTRACT

A process for making ductile iron castings and apparatus for practicing the process wherein molten metal is poured through a pressure head into a sealed reaction chamber adapted to contain a nuduralizing agent and then into a reservoir from which the molten metal flows to the casting cavity; the reaction chamber and reservoir are formed in the top surface of a single mold part of a two part mold assembly; the rate of molten metal flowing into the reaction chamber is greater than the rate of molten metal flowing from the reaction chamber and the rate of molten metal flowing into the reservoir is greater than the rate of molten metal flowing from the reservoir to the casting cavity.

16 Claims, 1 Drawing Sheet

PROCESS AND APPARATUS FOR PRODUCING DUCTILE IRON CASTINGS

Figure 1:
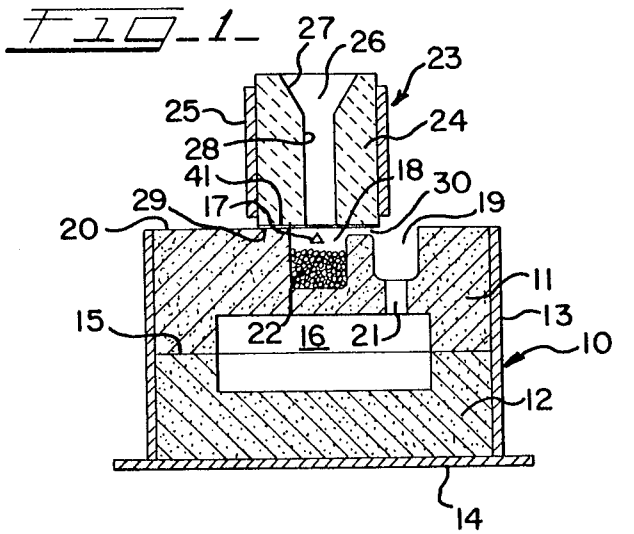

This is a continuation of application Ser. No. 898,769 filed Aug. 14, 1986, now abandoned, which is a continuation of application Ser. No. 630,546 filed July 13, 1984, now abandoned.

This invention relates to a new and improved process for producing castings of ductile iron, such as nodular or spheroidal graphite cast iron, and to apparatus for practicing the process.

Generally, ductile iron castings are produced by pretreating or preconditioning molten gray cast iron utilized for the castings in such a manner that the graphite flakes that are usually present in gray cast iron are caused to assume a nodular or spheroidal form in the solidified casting. The molten gray cast iron has a suitable chemical composition, including a relatively low sulphur content, which renders it amenable for conversion to ductile iron. The pretreating or preconditioning of the molten metal usually involves some means for dissolving or inoculating a suitable nodularizing agent of a proper amount into such molten gray iron. The nodularizing agents generally employed in the production of nodular or spheroidal graphite cast iron castings are composed of alloys, compounds or mixtures, of magnesium, calcium, lithium, strontium, barium, cerium, didynium, lanthanum and yttrium, and other similar metallic elements, and are usually in granular, powder or solid form. Nodularizing alloys are not only relatively costly and, thus, a significant factor in cost of producing ductile iron castings, but are, also, readily oxidizable at the pouring temperature of the molten cast iron and have boiling points below such pouring temperature.

As a consequence of the above, inoculation of the molten cast iron with the nodularizing agent can and often does result in a violent reaction tantamount to a dangerous explosion. Noxious fumes are emitted in abundance and pyrotechnics accompany the dissolving of the nodularizing agent within the molten gray cast iron bath. Not only does such violent reaction seriously contaminate the environment and possibly injure foundry personnel but also a sizable amount of the nodularizing is lost through oxidation and other causes, such as being physically rejected from the molten metal bath. Moreover, the amount of nodularizing in solution may diminish from the time the molten iron is first inoculated to time when the molten metal actually enters the mold cavity. This phenomena is known as "fading" in the foundry industry. As a result of such "fading" and/or oxidation of the nodularizing agent from the molten metal bath, the effectiveness of the nodularizing agent to properly nodularize the molten gray cast iron is reduced considerably.

Merely utilizing a larger quantity of nodularizer than theoretically required to achieve the degree of nodularization desire to compensate for the reduction of the amount of nodularizing agent in solution within the mold cavity, while appearing to be a simple solution to the problem, has not been a satisfactory solution from a commercial standpoint. As pointed out above, nodularizing agents are relatively expensive and, consequently, such solution to the problem would obviously increase the cost of manufacture immensely. Furthermore, the utilization of excessive quantities of nodularizing alloys tends to have an undesirable effect on the cleanliness of the castings as well as to generate other defects effecting the physical properties of the casting.

Ever since the ability to nodularize gray cast iron by treating a molten gray cast iron bath with specific nodularizing agents was first evolved, many technical solutions have been progressively proposed to overcome the aforementioned serious, dangerous and difficult problems in the manufacture of ductile iron castings. While those technical solutions which have been proposed have, for the most part, progressively mitigated such ductile iron casting problems, even the most technologically-advanced solutions still possess certain serious shortcomings.

Initially, the nodularizing agent was usually added to the molten metal bath or charge while such molten metal was still in the ladle by such techniques known as plunging or immersion. Many variations of such plunging or immersion techniques were also advanced. As an example, in order to slow down the reaction time or, in effect, to control the rate at which the nodularizing agent enters the molten metal bath or charge, the volatile nodularizing agent oftentimes was encapsulated with a material capable of "shielding" the nodularizing agent from the effect of the molten metal in a controlled manner. A further modification those techniques involving the direct disolving of the nodularizing agent while the molten cast iron is still in the ladle is disclosed in U.S. Pat. No. 3,367,395, issued Feb. 6, 1968. In that patent the nodularizing agent is in the form of an elongated solid bar and the lower end of the bar is disposed at the pouring lip of the ladle so as to be in position to be washed by and thus enter into the stream of the molten metal as it flows over the ladle pouring lip. A similar method for feeding magnesium alloy or the like into a stream of molten iron for the preparation of nodular cast iron is disclosed in U.S. Pat. No. 3,514,285, issued May 26, 1970.

A second category of processes for manufacturing ductile iron castings broadly involves adding the nodularizing agent to the molten iron charge in a stream immediately before entering the mold. The molten metal is caused to flow through an intermediate chamber disposed exteriorly of the mold. The intermediate chamber in which the nodularizing agent is disposed is interposed between the ladle and the mold. By sealing the nodularizing agent-containing intermediate chamber the pyrotechnic display, for the most part, can be eliminated. However, fading can occur during the travel of the molten iron from the reaction chamber to the mold cavity. A process representative of this category is disclosed in U.S. Pat. No. 3,819,365, issued Jan. 25, 1974.

A third classification or category of processes for manufacturing ductile iron castings are broadly known as "in-mold" processes and involve disposing the nodularizing agent in a portion of the gating system within the mold itself. Examples of the processes of such third category are found in U.S. Pat. Nos. 3,703,922, issued Nov. 28, 1972; 3,746,078, issued July 17, 1973; and 4,037,643, issued July 26, 1977, and Canadian Pat. No. 1,076,319 to Mather et al. With the advent of the "in-mold" processes broadly classified in such third category, it became possible to overcome many of the manufacturing problems noted above to a great degree. The success of such "in-mold" processes to mitigate the aforementioned and other manufacturing problems has been partly due to the fact that the nodularizing agent is usually disposed within a reaction chamber which is substantially sealed from the atmosphere and such nodularization of the molten cast metal is achieved in relatively close proximity to the mold cavity. While the so-called "in-mold" processes have definitely achieved a more efficient use of nodularizing agents by substantially reducing oxidation thereof during the inoculating step as well as by substantially eliminating the phenomena of "fading", other new and vexatious problems were engendered.

Inasmuch as the reaction chamber becomes, in effect, a part of the gating system of the "in-mold" processes of such third category, above, the volume of the gating system, of necessity, is increased to thus require the pouring of metal in an amount for greater than would be required in a conventioal mold where the molten metal is nodularized prior to entering the mold. Obviously, this results in an increase in scrap losses and a waste of nodularized molten iron. Thus, the overall cost of producing ductile iron castings by such processes is adversely affected. Moreover, since the reaction chamber is disposed on both sides of the mold parting line, whether such molds are vertically parted or horizontally parted, the size or number of the mold cavity or cavities that may be included in a mold assembly of a given external dimension is obviously limited. Additionally, in order to practice any of the "in-mold" processes disclosed in the above-noted patents a special pattern is required for each casing configuration. Of necessity, the pattern plate of each casting configuration must also have formed thereon the special gating system with reaction chamber embodied therein. Thus, from an economic standpoint, the capital equipment costs to commercially practice any of the so-called "in-mold" processes to manufacture ductile iron casting configurations of many sizes and shapes at a single foundry facility can become prohibitive.

It is therefore, a general object of the present invention to provide a new and improved method and apparatus for practicing the method for producing ductile iron castings wherein the above-noted and other manufacturing problems related to the manufacture of ductile iron are eliminated and the shortcomings, noted above, and other deficiencies inherent in or associated with known "in-mold" processes for making ductile iron castings are substantially obviated.

Still another object is to provide a process and apparatus for making ductile iron castings that is particularly adaptable to operations where a high rate of production of castings of many different sizes and shapes at reasonable cost and excellent uniformity of quality of such castings are desired.

An important object of the present invention is the provision of a novel method and apparatus for inoculating molten metal with a volatile nodularizing agent during the casting operation whereby "fading" of the modularizing agent (effects) due to oxidation, evaporation and other causes is substantially precluded to thus reduce the overall cost of manufacturing ductile iron castings.

A still further object is to provide a unique gating system for making a casting of ductile iron which includes a reaction chamber adapted to contain the nodularizing agent; the reaction chamber opens into the top or uppermost surface of the mold assembly to thereby permit relatively easy deposition of the proper amount of nodularizing agent within the reaction chamber and such placement of the nodularizing agent within the reaction chamber can be accomplished after the mold parts are fully assembled and in condition for receiving the molten metal.

A more specific object of the present invention is to provide a method and apparatus for making ductile iron castings wherein the reaction chamber for containing the nodularizing agent opens into the uppermost surface of the mold so as to afford convenient inspection of the nodularizing agent immediately prior to pouring the molten metal into the mold cavity.

Still another object of the invention is the provision of a process and apparatus for making ductile iron castings wherein an elongated reservoir is formed in the uppermost top surface of the mold; the reservoir is in fluid communication with the mold casting cavity or cavities and is adopted to receive molten metal therein molten gray cast iron therein which has been inoculated with a nodularizing agent.

A still further object of the present invention is the provision of a process and apparatus for making ductile iron castings utilizing a multi-part mold assembly wherein the reaction chamber for containing the nodularizing agent and a reservoir for receiving the nodularized molten metal from the reaction chamber and holding the same prior to its flowing to the mold casting cavity or cavities are provided entirely within a single one part of the multi-part mold assembly.

Still another object is the provision of a process and apparatus for making ductile iron castings which can be readily incorporated into a conventional gray cast iron casting operation so as to enable such operation to produce ductile iron castings with a relatively small increase in equipment costs.

A still futher object is to provide a novel squeeze board having a reaction chamber pattern and reservoir pattern mounted thereon which squeeze board may be utilized for the gating system for an innumerable number of different sizes and shapes of casting cavities.

Still another object is the provision of a method and apparatus for producing iron castings that is particularly adapted for use with horizontally parted molds.

In summary, the present invention contemplates the provision of a chamber in the uppermost portion of the mold assembly in which the casting is to be formed. The chamber opens into the uppermost or top surface of the mold assembly and is adapted to have an inoculating agent placed therein. The chamber is, in effect, part of the gating system and thus as the molten metal flows through the chamber containing the nodularizing agent on its way to the mold casting cavity or cavities such molten iron is nodularized. To avoid the violent reaction resulting when the molten gray cast iron encounters the nodularizing agent and its attendant generation of noxious fumes and pyrotechnics the top or open end of the chamber is closed and sealed from the atmosphere by a pressure head which operatively engages the uppermost or top surface of the mold assembly. The molten metal is adapted to flow through the pressure head and into the chamber wherein it reacts with the nodularizing agent and then flows through an outlet opening partially defined by the lowermost portion of the pressure head. The invention contemplates the provision of an elongated reservoir which is also formed in the top or uppermost surface of the mold assembly. The reservoir serves as a basin for receiving and holding molten metal which has been treated with a nodularizing agent in the reaction chamber. The bottom of the reservoir is in fluid communication with the uppermost end of a downsprue which has its other end in fluid communication with the mold casting cavity or cavities in a conventional manner. The cross sectional area of the outlet of the reaction chamber or inlet to the reservoir is selected so as to be larger than the cross sectional area of the downsprue whereby the reservoir serves as a holding basin for the molten metal to thus assure an adequate flow of clean metal for filling the mold casting cavity or cavities. The seal formed at the juncture of the lowermost surface of the pressure head with the uppermost mold surface encircling the reaction chamber effectively precludes the discharge of noxious fumes into the atmosphere during the pouring operation and also eliminates hazards that might otherwise occur from the pyrotechnics that can take place when molten iron encounters a volatile nodularizing agent. The elongated open top reservoir serves as a holding basin for the molten metal. The outlet of the reservoir being in the botton of the reservoir and being of smaller cross sectional area than the inlet to the reservoir assures an adequate head of clean molten metal through the downsprue to thereby minimize the inclusion of slag and the aspiration of air into the solidified casting. Any slag inclusions that may be in the molten metal will rise to the top surface of the metal contained within the reservoir during the pouring operation and by properly controlling the amount of molten metal introduced into the reaction chamber during the pouring operation such slag inclusions will not enter the mold casting cavity but rather will be disposed within the solidified scrap metal that might be remaining in the reservoir and/or downsprue.

The invention also contemplates the provision of novel apparatus for making ductile iron castings comprising a two-part mold assembly which mold parts are horizontally parted or separated and wherein the top or uppermost, substantially flat surface of the cope or uppermost mold part of the mold assembly is provided with a reaction chamber adapted to have a nodularizing agent deposited therein through the open top thereof. The invention further contemplates the provision of a reservoir which also opens into the uppermost or top surface of the cope mold part and is in fluid communication with the reaction chamber through an inlet passageway. The bottom of the elongated reservoir is in fluid communication with a mold casting cavity formed in both the cope and drag mold parts in a conventional manner by means of a downsprue formed through the cope mold part. The cross sectional area of the reservoir outlet is smaller than the cross sectional area of the reservoir inlet so that the reservoir remains substantially full of molten metal during the entire pouring operation.

Still another object of the invention is the provision of a method and apparatus for practicing the method for making ductile iron castings wherein the gating system includes a reaction chamber for containing the nodularizing agent as well as a elongated reservoir, both of which open into the top or uppermost surface of the cope mold part; the invention contemplates supplying molten iron directly to the nodularizing chamber from a pressure head in such a manner that the chamber is effectively sealed from the atmosphere. The rate of molten metal entering the nodularizing chamber is accurately controlled and is greater than the rate at which it is permitted to flow into the reservoir. Additionally, the rate at which molten metal enters the reservoir during the pouring operation is greater than the flow rate of the molten metal leaving the reservoir on its way to the mold casting cavity. As a result of the foregoing, the nodularizing chamber becomes filled with molten iron rapidly at the start of the pouring operation to thus preclude rapid oxidation and evaporation of the nodularizing agent and discharge of noxious fumes or gases into the work environment. Moreover, since the volatile nodularizing agent is covered with the molten iron quickly, hazards that might otherwise occur from the pyrotechnics that can take place when molten iron encounters a volatile nodularizing agent in the presence of oxygen are effectively eliminated. Also, by controlling the rate of molten metal flowing into and out of the reservoir, in the manner as pointed out above, the reservoir becomes substantially filled with molten metal which has been inoculated and remains substantially filled with molten metal during the entire pouring operation. Thus, the reservoir serves as a retention basin for a relatively large quantity of inoculated molten iron to assure the elimination of slag inclusions or other impurities which tend to float to the top of the molten metal bath retained in the reservoir and aspiration of air in the solidified casting.

Figure 2:
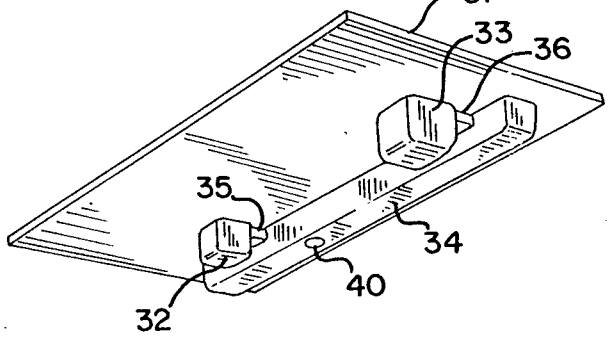
Figure 3:
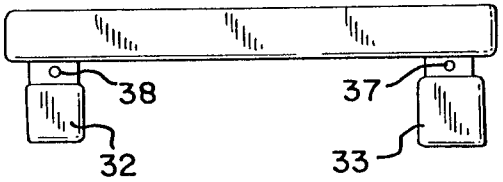
Figure 4:
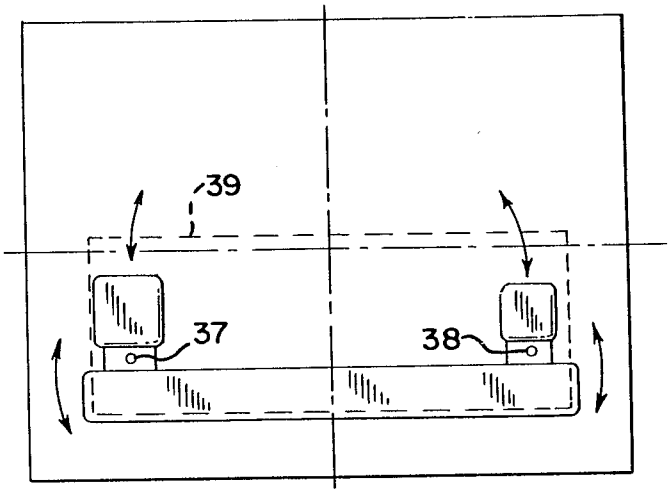

The foregoing and other important objects and desirable features inherent in and encompassed by the invention together with many of the purposes and uses thereof will become readily apparent from a reading of the ensuing description in conjunction with the annexed drawings, in which, FIG. 1 is a vertical sectional view of apparatus embodying the invention and capable of practicing the inventive method;

FIG. 2 is a perspective view of the underside of a cope squeeze board having a pattern structure mounted thereon which is useable to form the reaction chamber/reservoir cavities in the top or uppermost surface of the cope or uppermost mold part; the pattern structure includes a small reaction chamber pattern, a large reaction chamber pattern, and a single reservoir pattern and is adjustably mounted on the underside of the board whereby a single cope squeeze board can be used for making a portion of the novel gating system utilized in practicing the present invention in the production of ductile iron castings of two ranges of weight;

FIG. 3 is a botton plan view of the reaction chambers/reservoir pattern structure shown in FIG. 2 but detached from the underside of the board; and FIG. 4 is a botton plan view of the cope squeeze board illustrating the manner in which the reaction chambers/reservoir pattern structure may be adjusted with respect to the squeeze board proper to accommodate greatest downsprue locations.

Referring to the drawings in detail wherein like reference characters represent like elements throughout the various views, a mold assembly is designated in its entirety by reference character 10. While it is to be understood that the invention may be utilized with molds of various materials, types and sizes for making metal castings of different sizes and shapes, the invention is described herein as used in conjunction with the production of ductile iron castings in horizontally parted molds. As such, the cope mold part 11 is disposed over the drag mold part 12 in a conventional manner. Suitable means in the form of an enclosure 13 are employed for laterally supporting the cope mold part 11 over the drag mold part 12. The mold assembly 10, as shown in FIG. 1, is supported upon a bottom plate 14. The cope and drag parts 11, 12 shown in FIG. 1 are made of conventional foundry sand. However, it is to be understood that the mold parts 11, 12 could be made of other materials and could take other forms and shapes, depending upon the size and character of the article to be formed or cast and other factors, without departing from the spirit and scope of the invention. Not only may the mold parts 11 and 12 be formed of any selected or required refractory material or permanent mold material but the size and shape of the mold assembly 10 may be varied greatly and still be useable to practice the present invention.

As in a conventional horizontally parted mold assembly, the lowermost or bottom surface of the cope sold part 11 of the mold assembly 10 is substantially flat and abuts the uppermost, substantially flat surface of the drag mold part 12 at a line of parting or parting surface 15. A casting cavity 16, having the size and configuration of the article to be cast in ductile iron, has portions above as well as below the parting surface 15 as in conventional mold assemblies.

In order to supply the casting cavity 16 with molten metal a gating system, designated generally by reference character 17, is provided. The gating system 17 includes a cup-shaped reaction chamber 18 and an elongated reservoir 19 which has a volumetric capacity considerably larger than the chamber 18. The reaction chamber 18 and reservoir 19 open into the uppermost or top, substantially flat, surface 20 of the cope mold part 11. The gating system 17 also includes a downsprue 21 which has one end opening into the bottom wall of the reservoir 19 and its opposite end in fluid communication with the mold casting cavity 16. The gating system 17 may contain other devices, such as horizontal runners and the like, for providing fluid communication between the downsprue 21 and the mold casting cavity 16. From the foregoing, it will be appreciated that substantially the entire gating system 17 is formed within the cope mold part 11. The significance of such will be pointed out hereinafter.

Inasmuch as the top of the reaction chamber 18 is open, the nodularizing agent 22 may be conveniently placed within the chamber 18. The nodularizing agent 22, as pointed out hereinbefore, maybe in the form of lumps, powder, granular or crushed aggregate and may be composed of any well known or common nodularizing alloys such as those containing magnesium, calcium, and similar materials.

Molten metal is introduced to the gating system 17 by means of a pressure head, designated generally by reference character 23. The pressure head 23 includes a body 24 of refractory material which is enclosed by an encircling steel support member 25. As shown in FIG. 1, an elongated cylindrical passageway 28 is formed in the body 24*f* of the pressure head 23. The elongated cylindrical passageway 28 extends from the normally lowermost or bottom surface 29 of the pressure head to a funnel-shaped, enlarged cavity 27 formed in the uppermost part of the pressure head body 24. The pressure head 23 is moveable in use so as to be positioned directly over the chamber 18 during the molten metal pouring operation with the cylindrical passageway 28 thereof substantially in vertical alignment with the vertical central axis of the chamber 18 and with the bottom surface 29 thereof engaging the portion of the cope mold top surface 20 encircling and defining the opening of the chamber 18 into such cope mold top surface 20. The enlarged, funnel-shaped cavity 27 facilitates pouring of the molten iron and ensures a smooth and uniform flow of molten iron into the reaction chamber 18 so as to enable complete filling of the reaction chamber 18 in a relatively short period of time. Inasmuch as the chemical reaction commences immediately upon the molten metal contacting the nodularizing agent 22, it is important that the open top of the reaction chamber 18 be sealed from the atmosphere and the chamber be filled with molten metal as rapidly as possible so that the volatile nodularizing agent 22 will be covered almost immediately by a substantial wire or column of molten metal. By sealing the juncture of the pressure head 23 and the cope mold portion top surface 20 and completely filling the reaction chamber 18 as quickly as possible, the nodularizing agent 22 will be effectively isolated from the atmosphere and the chemical reaction between the nodularizing agent 22 and the molten iron flowing through the chamber 18 during the pouring operation will occur without a pyrotechnic and/or the emission of air pollutants.

The present invention accomplishes this objective, in part, by causing the substantially flat, lowermost or bottom surface 29 of the pressure head 23 to firmly abut the portion of the top surface 20 of the cope mold part 11 surrounding the top opening of the reaction chamber 18. In order to ensure rapid filling of the reaction chamber 18 the molten metal inlet and outlet means are designed such that the rate of metal flow entering the chamber 18 is greater than the rate of metal flowing from th reaction chamber 18.

As pointed out hereinbefore, the reaction chamber 18 and the elongated reservoir 19 are in fluid communication with each other. The present invention contemplates the provision of chamber outlet means (or reservoir inlet means) 30 which includes a channel formed in the top surface 20 of the cope mold part 11. One end of the channel of chamber outlet means 30 opens into an upper part of the chamber 18 and its opposite end opens into the upper end of the reservoir 19, as best illustrated in FIG. 1. It will be appreciated after viewing FIG. 1 that when the pressure head 23 is in its metal pouring position, as shown in FIG. 1, a portion of the bottom surface 29 of the pressure head 23 overlies the channel and, in effect, substantially closes the open top thereof. Thus, such bottom surface portion of the pressure head 23 partially defines a wall of the chamber outlet means 30. Therefore, in order to ensure rapid filling of the reaction chamber 18 by controlling the rate of the metal flowing into, and out of the reaction chamber 18 the cross-sectional area of the passageway 28 formed in the pressure head 23 and which serves as the inlet means for molten metal entering the reaction chamber 18 is made larger than the cross-sectional area of the reservoir outlet channel. By controlling the rate of molten metal flowing into and out of the reaction chamber 18 complete and uniform nodularization of the molten iron is progressively achieved without risk of explosions or the contamination of the work environment with air pollutants.

As pointed out hereinbefore the invention also contemplates the provision of a reservoir 19 which serves as a retention basin for monentarily retaining or holding a relatively large volume of inoculated molten metal before it enters into the downsprue 21 and flows into the mold casting cavity 16. By monentarily retaining the molten metal in such basin, any slag inclusions or other impurities present in the inoculated molten metal flowing into the reservoir 19 are permitted to rise to the top of the molten metal contained within the reservoir 19 and not enter the downsprue 21. The rapid filling of the reservoir 19 to substantially its full capacity and the maintenance of such quantity of molten metal therein during substantially the entire pouring operation is assured by controlling the rate of molten metal flowing into and out of the reservoir 19 in such a manner that molten metal is capable of flowing into the reservoir at a faster rate than it can flow out of the reservoir 19. This is accomplished by making the cross-sectional area of the downsprue 21 at the bottom wall of the reservoir 19 smaller than the cross-sectional area of the chamber outlet or reservoir inlet means 30. In use, it has been found that for castings of approximately 12 to 36 pounds the ratio of the cross-sectional area of the reservoir inlet means 30 to the cross-sectional area of the downsprue 21 at the bottom wall of the reservoir 19 should be preferably of about 3 to 1 while for pouring larger castings the ratio should be about 2 to 1. It is desirable to retain molten metal as long as possible in the reservoir 19. Therefore, when pouring a relatively small casting, all the molten iron required to make the casting can generally be contained in the reservoir 19 and the pressure head 23. Thus, molten metal can be retained in the reservoir 19 almost until the end of the pouring operation. Thus, a reservoir inlet area/reservoir outlet area ratio of about 3 to 1 is feasible. In the case of castings requiring a larger amount of molten metal than can be contained in the reservoir 19 and pressure head 23, the ratio of the reservoir inlet area to the reservoir outlet area has to be smaller and in the neighborhood of 2 to 1 to avoid molten iron overflowing the reservoir 19 before the required weight of molten metal is poured.

From the foregoing, it will be appreciated that it is absolutely essential that the seal between the pressure head and the top surface 20 of the cope mold part 11 be free of surface irregularity which could result in leakage of air into the reaction chamber 18 and/or the emission of contaminating reaction products into the atmosphere and the possible occurrence of dangerous pyrotechnics. Thus, it is desirable to maintain the bottom surface 29 of the pressure head 23 relatively clean and smooth. It has been found that by placing relatively thin sheet means 41 between the bottom surface 29 of the pressure head and the portion of the top surface 20 of the cope mold part 11 surrounding the top opening of the reaction chamber 18 prior to the start of the pouring operation, reaction products are effectively prevented from sticking to the pressure head bottom surface 29. The sheet means 41 is preferably made of paper or paper-like material and may comprise a single sheet or multiple layers.

To facilitate making the molds necessary for practicing the inventive process described herein, a cope squeeze head or board 31 was developed. As best shown in FIG. 2, a pattern structure, preferably made of cast aluminum, is mounted on the underside of the generally rectangularly-shaped cope squeeze head or board 31. The pattern structure includes a small reaction chamber pattern 32, a large reaction chamber pattern 33, a single elongated reservoir pattern, a reservoir outlet dhannel pattern 35 extending between the small reaction chamber pattern 32 and the reservoir pattern 34 adjacent one end of the reservoir pattern 34, and a second reservoir outlet channel pattern extending between the large reaction chamber pattern 33 and the reservoir pattern 34 adjacent the end of such reservoir pattern 34 opposite the end adjacent to the small reservoir chamber pattern 32. Thus, with a single cope squeeze head or board 31 the cope mold part 11 may be readily prepared for practicing the inventive process described herein. From the foregoing, it will be appreciated that the shape of the pattern structure can be easily impressed (embossed) into the cope mold part top surface 20 during the mold-making operation. Inasmuch as two sizes of reaction chambers 18 are formed into the top surface 20 of the cope mold part 11 each time the cope squeeze board 31 is utilized in the mold-making operation, only a single cope squeeze head or board 31 of the design illustrated in FIG. 2 is required to make molds for the casting two weight ranges. Additionally, it is contemplated that the pattern structure be mounted on the underside of the rectangular cope squeeze head or board 31 in such a manner that it can be adjusted with respect thereto, as indicated by arrows of FIG. 4. Pin means 37 and 38 are provided for facilitating such mounting adjustment of the pattern structure on the cope squeeze board or head 31 underside. It will be appreciated that the reservoir 19 must be in alignment with the downsprue 21 of the mold and, consequently, by permitting the pattern structure be adjusted with respect to the underside of the cope squeeze board or head 31, as pointed out hereinbefore, the cope squeeze board or head 31 illustrated in 32, can be used in making molds requiring downsprue locations within the area enclosed by dotted line 39 of FIG. 4. A typical downsprue location is indicated by reference character 40 in FIG. 2.

The embodiment of the invention chosen for the purposes of illustration and description herein is that preferred for achieving the objects of the invention and developing the utility thereof in the most desirable manner, due respect being had to existing factors of economy, simplicity of design and construction, manufacturing techniques and the improvements sought to be effected. It will be appreciated therefore that the particular structural and functional aspects emphasized herein are not intended to exclude but rather to suggest such other adaptations and modifications of the invention as fall within the spirit and scope of the invention as defined in the appended claims.

What is claimed is:

1. Apparatus for making iron castings comprising, a mold assembly having at least two mold parts, each of said mold parts having first and second substantially flat surfaces, said first and second substantially flat surfaces of each of said mold parts being spaced and substantially parallel with respect to each other and said first substantially flat surface of one of said mold parts abutting said first flat surface of the other mold part; casting cavity means formed in both of said mold parts; a downsprue communicating with said casting cavity means; and gating means including a reaction chamber, said gating means having a first entry location for receiving molten metal entering the mold and consisting of the entire path for molten metal between said entry location and said downsprue, said gating means being formed independently of siad casting cavity means and disposed substantially entirely within a respective one of said mold parts and opening along its entire length into said second substantially flat surface of a respective one of said mold parts, said gating means being defined solely by the walls of said one of said mold parts, said mold being characterized by the absence of cores within that portion of the mold containing said gating means.

2. Apparatus for making iron castings as set forth in claim 1, wherein said gating means includes a chamber having its top opening into said second substantially flat surface of said respective one of said mold parts, said chamber being adapted to have a nodularizing agent deposited therein through the open top thereof; a pressure head having a substantially flat sealing surface formed thereon adapted to make sealing engagement with a surface portion of said second substantially flat surface of said respective one of said mold parts encircling and defining the open top of said chamber, said sealing surface of said pressure head being moveable into and out of sealing engagement with said surface portion of said second substantially flat surface of said respective one of said mold parts, said pressure head further having a passageway formed therethrough adapted to receive molten metal at one end and to deliver the same to said chamber through the open top thereof when said sealing surface of said pressure head is in sealing engagement with said surface portion of said second substantially flat surface of said respective one of said mold parts.

3. Apparatus for making iron castings as set forth in claim 2, wherein said gating means further includes an elongated reservoir adjacent to said chamber having its top opening into said second substantially flat surface of said respective one of said mold part, fluid inlet means providing fluid communication between said chamber and said reservoir, and fluid outlet means for providing fluid communication between said reservoir and said casting cavity means.

4. Apparatus for making iron castings as set forth in claim 3, wherein the cross sectional area of said fluid inlet means is larger than the cross sectional area of said fluid output means.

5. Apparatus for making iron castings as set forth in claim 4, wherein the cross sectional area of said passageway formed through said pressure head is larger than the cross sectional area of said fluid inlet means providing fluid communication between said chamber and said reservoir.

6. Apparatus for making iron castings as set forth in claim 5, wherein in the cross sectional area of said fluid inlet means is at least twice as large as the cross sectional area of said fluid outlet means.

7. Apparatus for making iron castings as set forth in claim 3, wherein said fluid inlet means includes a channel extending between and opening into said chamber and said reservoir, said channel having its top opening into said second substantially flat surface of said respective one of said mold parts, a portion of said sealing surface of said pressure head overlying said top opening of said channel to thereby partially define said fluid inlet means when said pressure head is in sealing engagement with said surface portion of said second substantially flat surface of said respective one of said mold parts.

8. Apparatus as set forth in any one of claims 2 to 7, inclusive, further including a relatively thin sheet means interposed between and operatively engaging said sealing surface of said pressure head and said surface portion of said second substantially flat surface of said respective one of said mold parts when such sealing surface and surface portion are in sealing engagement.

9. Apparatus as set forth in any one of claims 1 to 6, inclusive, wherein said mold assembly includes a cope mold and a drag mold, said cope mold being mounted vertically above said drag mold with their abutting surfaces lying substantially in a horizontal plane; and said gating means being disposed substantially entirely within said cope mold.

10. A method of making metal castings comprising, providing a mold assembly including a cope mold and drag mold having abutting surfaces lying substantially in a horizontal plane, and a casting cavity formed in each of said cope mole and drag mold; forming an entire gating means substantially entirely within said cope mold solely by impressions mounted on a cope squeeze plate, said gating means providing fluid communication between the uppermost surface of said cope mold and a downsprue in communication with said casting cavity, said gating means including a molten metal receiving reaction chamber and consisting of the entire molten metal path within said mold from and including said chamber to but not including said downsprue, the entire top of said gating means opening into the uppermost surface of said cope mold, said mold being characterized by the absence of cores within the portion of the mold containing said gating means; and sealing said open top of said chamber and supplying said mold assembly with sufficient molten metal through said sealed open top of said chamber to fill the casting cavity.

11. A method of making metal castings as set forth in claim 10, wherein said gating means includes an elongated reservoir having its top opening into said uppermost surface of said cope mold, said reservoir having a volume greater than said chamber, said gating means further including fluid inlet means providing fluid communication between said reservoir and said chamber and fluid outlet means providing fluid communication between said reservoir and said casting cavity, said fluid inlet means being formed so as to have a greater cross sectional area than the cross sectional area of said fluid outlet means whereby molten metal flows into the reservoir at a rate greater than the flow of molten metal from the reservoir into the casting cavity.

12. A method of making metal castings as set forth in claim 11, wherein said fluid inlet means is formed so as to be vertically spaced above the bottom of said chamber and said fluid outlet means.

13. A method of making ductile iron castings comprising, providing a mold assembly including a cope mold and drag mold having abutting surfaces lying substantially in a horizontal plane, a casting cavity formed in each of said cope mold and drag mold; forming an entire gating means solely with a cope squeeze plate substantially entirely within said cope mold for providing fluid communication between the uppermost surface of said cope mold and a downsprue communicating with said casting cavity, said gating means including a molten metal receiving reaction chamber and consisting of the entire molten metal path within said mold from and including said chamber to but not including said downsprue, said gating means having its entire top opening into the upper surface of said cope mold, said mold being characterized by the absence of cores within the portion of the mold containing said gating means; depositing a nodularizing agent in the reaction chamber through the open top thereof; operatively engaging the uppermost surface of the cope mold with a sealing surface of a pressure head, said pressure head sealing surface making sealing contact with a portion of the uppermost surface of the cope mold surrounding said open top of said reaction chamber; and supplying said mold assembly with sufficient molten gray cast iron to fill the casting cavity by causing said molten gray cast iron to flow into said mold assembly through a downwardly extending passageway through said sealing surface of said pressure head.

14. A method of making ductile iron castings as set forth in claim 13, wherein said gating means includes an open top elongated reservoir, said reservoir opening into said uppermost surface of said cope mold, said gating means further including fluid inlet means providing fluid communication between said reaction chamber and reservoir and fluid outlet means providing fluid communication between said reservoir and said casting cavity.

15. The method of making ductile iron castings as set forth in claim 14, wherein said fluid inlet means has a greater cross sectional area than the cross sectional area of said fluid outlet means; and molten iron is supplied to said reaction chamber at a rate greater than the molten iron flows out of said reaction chamber through said fluid inlet means, and flows into said reservoir through said fluid inlet means at a rate greater than the molten iron flows out of said reservoir to said casting cavity through said fluid outlet means whereby said reaction chamber and said reservoir become filled and remain substantially filled with molten iron during the entire pouring operation.

16. A method of making ductile iron castings as set forth in claim 15, further including the step of interposing a nonmetallic sheet means between said pressure head sealing surface and said portion of the uppermost surface of the cope mold surrounding the open top of said reaction chamber.

* * * * *